United States Patent [19]

Amici et al.

[11] Patent Number: 4,622,020

[45] Date of Patent: Nov. 11, 1986

[54] GLOVE PUPPET FIGURE ASSEMBLY AND POWERED WING DRIVE MECHANISM

[75] Inventors: Francis R. Amici, Northford; Hans S. Berger, Plainville; Domenic G. Mercurio, Elmwood; John P. McNett, Farmington; Pietro Piazza, Prospect, all of Conn.

[73] Assignee: Coleco Industries, Inc., West Hartford, Conn.

[21] Appl. No.: 700,532

[22] Filed: Feb. 11, 1985

[51] Int. Cl.[4] ..... A63H 3/28

[52] U.S. Cl. ..... 446/298; 446/353; 446/379

[58] Field of Search ..... 446/35, 297, 298, 303, 446/353, 352, 330, 382, 379, 380, 97, 99, 418, 421, 422

[56] References Cited

U.S. PATENT DOCUMENTS

| | | | |
|---|---|---|---|
| 683,857 | 10/1901 | Kilpatrick . | |
| 928,744 | 7/1909 | Fisher . | |
| 1,417,860 | 5/1922 | Reich . | |
| 1,432,628 | 10/1922 | Slocum . | |
| 1,518,576 | 12/1924 | Edwards . | |
| 1,782,477 | 11/1930 | Price . | |
| 1,865,305 | 6/1932 | Dallas . | |
| 1,886,442 | 11/1932 | Wimmer | 446/338 |
| 2,036,328 | 7/1936 | Furey . | |
| 2,158,860 | 5/1939 | Hyde . | |
| 2,241,576 | 5/1941 | Barton . | |
| 2,302,349 | 11/1942 | Renshaw . | |
| 2,614,365 | 10/1952 | Musselwhite et al. . | |
| 2,637,939 | 5/1953 | Polk . | |
| 2,725,670 | 10/1955 | Hodes . | |
| 2,756,448 | 7/1956 | Werbe . | |
| 2,931,135 | 4/1960 | Zalkind | 446/353 X |
| 3,153,871 | 10/1964 | Semba . | |
| 3,358,400 | 12/1967 | Katz et al. . | |
| 3,568,363 | 3/1971 | Tanimura | 446/293 |
| 3,577,670 | 5/1971 | Gutierrez . | |
| 3,698,127 | 10/1972 | Harp . | |
| 3,828,469 | 8/1974 | Giroud . | |
| 3,918,180 | 11/1975 | Chamberlin . | |
| 3,942,283 | 3/1976 | Rushton . | |
| 4,056,896 | 11/1977 | Karasawa | 446/191 |
| 4,155,195 | 5/1979 | Leigh-Hunt | 446/35 |
| 4,207,704 | 6/1980 | Akiyama . | |
| 4,216,612 | 8/1980 | Erickson et al. | 446/382 X |
| 4,244,138 | 1/1981 | Holahan et al. . | |
| 4,304,065 | 12/1981 | Baiera . | |
| 4,307,533 | 12/1981 | Sims et al. . | |
| 4,324,065 | 4/1982 | Cooper . | |

*Primary Examiner*—Mickey Yu

[57] ABSTRACT

A glove puppet figure has wings capable of simulating flapping movement while producing an audible sound, and driven by a mechanism that is uncomplicated and yet effective. The figure may have a head component that can be moved, by manipulation of the operator's finger, relative to a body which is held substantially immobile on the operator's hand, and the glove empolyed is not only functional but also contributes to aesthetic appeal. The wings are removably mounted to the body by flexible coupling members. The wings are fabricated from a synthetic resinous laminate and provides an iridescence to the wings.

19 Claims, 10 Drawing Figures

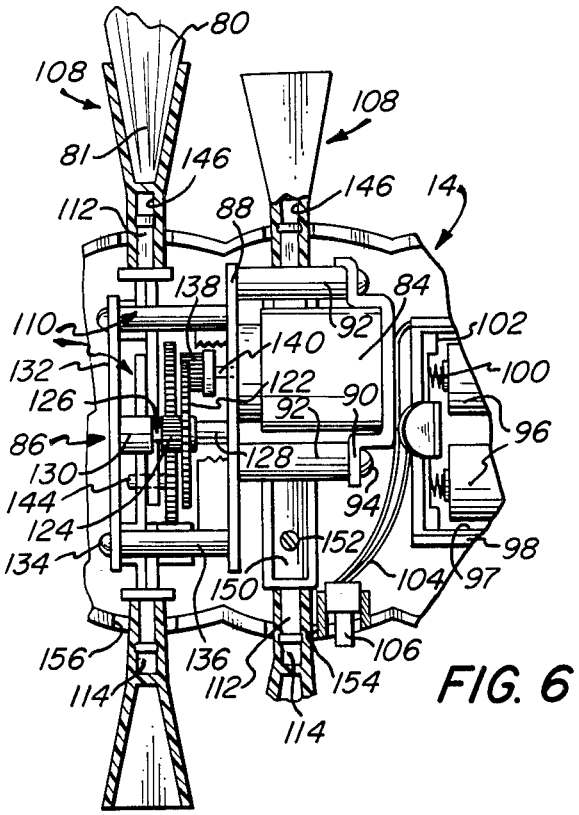
FIG. 6
FIG. 9
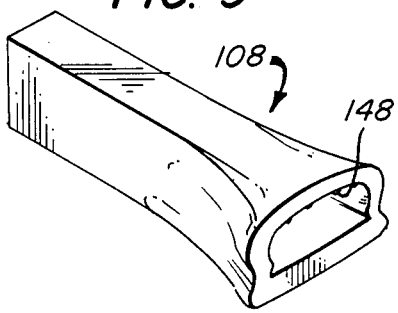
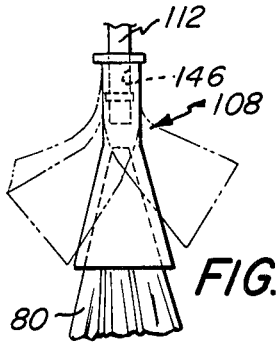
FIG. 10
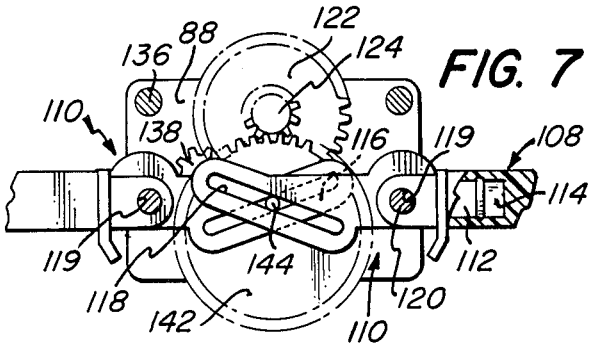
FIG. 7
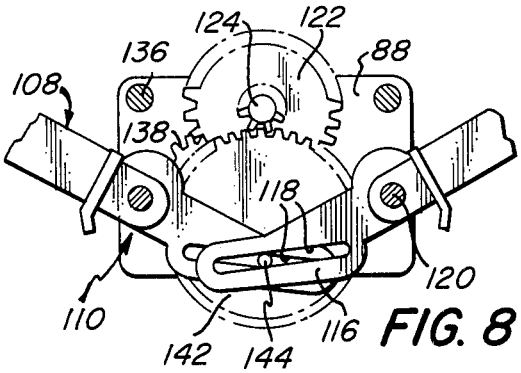
FIG. 8
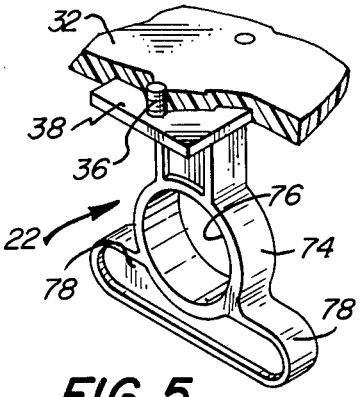
FIG. 5

GLOVE PUPPET FIGURE ASSEMBLY AND POWERED WING DRIVE MECHANISM

BACKGROUND OF THE INVENTION

Toys capable of animation have long found widespread appeal among children, and are disclosed in numerous forms in the prior art. One form of such action toys simulates a creature having wings that are movable in a flapping action, as disclosed in the following U.S. patents: U.S. Pat. No. 2,036,328 to Furey; U.S. Pat. No. 2,637,939 to Polk; U.S. Pat. No. 3,153,871 to Semba; U.S. Pat. No. 3,577,670 to Gutierrez; U.S. Pat. No. 4,244,138 to Holahan et al; and U.S. Pat. No. 4,307,533 to Sims et al.

More particularly, the Furey patent describes a toy insect having movable wings that are operatively connected to a pair of ground-engaging wheels.

A flapping wing toy, constructed to simulate a bird or butterfly, is shown in the Polk patent; it employs a pair of hinged arms, oscillated by finger pressure, to which the wing sections are attached.

Semba shows the use of an electric motor to animate various parts of a bird toy, including the wings; projections on a rotated disc successively engage a rod to which the wings are attached, oscillating the rod and thereby causing a fluttering effect of the wings.

Gutierrez discloses a wing flapping toy in which the wings are loosely mounted upon a handle, and are held in place by a rubber band. The handle has a spring-like portion which terminates in a pair of parallel ears, disposed to force the wings to elevated positions when the handle is squeezed.

The Holahan et al patent describes an animated bird toy in which a trigger-like lever, pivotably mounted upon the body, is operated to simulate flapping of outwardly extending portions of the wings.

In the toy insect of the Sims et al patent, four wings are rotatably mounted upon pins attached to hinged mounting plates The plates are acted upon by a lever to elevate the wings against the force of gravity.

Animated toys have of course taken many other forms, with parts other than wings that are movable. Like the winged toys described above, they may be animated either manually (e.g., by finger movement, as in hand puppet toys, by pull strings, etc.) or by drive means (e.g., electric or spring-powered motors), and in some instances they may be capable of producing sounds as well. Exemplary of such prior art are the following United States patents:

Fisher describes, in U.S. Pat. No. 928,744, figure toys having illuminating means for the eyes, mouth and nostrils, and containing a button-operated mechanism for opening the mouth.

A toy in the form of an animal is described by Price in U.S. Pat. No. 1,782,477, wherein a spring-powered motor is provided to produce a walking action as well as movement of head components.

A toy figure having movable parts, animated by a spring motor, is shown in the patent to Hyde, U.S. Pat. No. 2,158,860.

A snake-like toy in the form or a plurality of segments is taught in U.S. Pat. No. 2,241,576 by Barton, wherein strings can be pulled to move the toy in various directions.

In U.S. Pat. No. 2,614,365 Musselwhite et al disclose a doll having arms that are moved by push-button actuation.

Katz et al. U.S. Pat. No. 3,358,400 provides a doll having pendulum-controlled eyes moved by a mechanism having cooperating cam and cam follower means.

Harp discloses a puppet in U.S. Pat. No. 3,698,127, which has a movable mouth operated by a pull string.

A head for a doll having lips which are movable to simulate talking is shown in Giroud U.S. Pat. No. 3,828,469; the mechanism used includes a wheel having eccentric studs, which is driven by a motor to impart a reciprocating displacement to the lips.

The patent to Akiyama U.S. Pat. No. 4,207,704, teaches a sound-producing animal-simulating toy in which a tape recorder can be employed to product voice or other sound.

A toy game, in the form of a simulated alligator body, is taught in the Cooper U.S. Pat. No. 4,324,065, wherein a leg of the alligator is tied to a latch for operating the upper jaws.

Hand and finger operated puppets or puppet-like toys are disclosed by Kilpatrick in U.S. Pat. No. 683,857; Reich in U.S. Pat. No. 1,417,860; Slocum U.S. Pat. No. 1,432,628; Edwards U.S. Pat. No. 1,518,576; Dallas U.S. Pat. No. 1,865,305; Renshaw U.S. Pat. No. 2,302,349; Werbe U.S. Pat. No. 2,756,448; and Chamberlain U.S. Pat. No. 3,918,180. Hodes U.S. Pat. No. 2,725,670 provides a manipulative animated toy in the form of a mouse in a cage, the mouse being articulated by finger movement. A hand puppet having legs and a head that can be moved by finger manipulation is taught in the patent to Rushton, U.S. Pat. No. 3,942,283. Baiera describes a puppet in the form of a walking or crawling creature, in U.S. Pat. No. 4,304,065; the body consists of a non-functional glove, and appendages into which the fingers of the operator are inserted for manipulation to simulate the walking action.

It is of course desirable to achieve optimal visual appeal, functional effectiveness, and durability in any such toy, while minimizing the complexity of the animating mechanism and the cost of manufacture. Despite the level of prior art activity indicated above, a demand remains for toys of unique construction, in which the foregoing criteria are realized.

Accordingly, it is a broad object of the present invention to provide a novel glove puppet figure having mechanically driven flappable wings, in which the operating mechanism is of relatively uncomplicated and durable construction.

It is also an object of the invention to provide such a puppet figure which is relatively economical to manufacture, and in which the parts employed are relatively simple and few in number.

Additional objects are to provide such a puppet figure in which the wings are readily removable, and in which movement of the wings is effective to produce an audible sound.

Another broad object of the invention is to provide a novel glove puppet figure having an articulated head attached to a body, the head being movable by finger manipulation while the body is held stationary on the operator's hand.

A more specific object of the invention is to provide such a puppet figure on which a unique gripping ring holder is employed, which not only permits articulation of the head while the body is held stationary, but also permits movement of the remaining fingers, such as to simulate walking or crawling legs of the puppet figure.

Yet another object of the invention is to provide a puppet figure having the foregoing features, in combination with a glove member which is constructed to serve both aesthetic and also functional purposes.

A still further object is to provide such a puppet figure having a body partially covered by a plush or fur-like material.

SUMMARY OF THE INVENTION

It has now been found that certain of the foregoing and related objects of the invention are attained by the provision of an assembly, for use in a toy creature having wings capable of simulating a flapping action, comprised of a frame, a cam gear, a pair of substantially mirror-image cam follower pieces, and drive means operatively connected to the cam gear. The cam gear has a gear portion and a centrally disposed axial shaft portion rotatably mounting it on the frame, and it has a drive pin projecting axially from the gear portion in eccentric relationship to the shaft portion. Each of the cam follower pieces has an outer end portion adapted to support a wing member, and an inner end portion with a slot therein dimensioned to slidingly engage the drive pin of the cam gear. The follower pieces are mounted on the frame, to opposite sides of the cam gear shaft portion, for pivoting about axes parallel thereto and between the inner and outer end portions of the follower pieces, the inner end portions being disposed in overlapped relationship with the pin slidingly engaged within the slots thereof. Rotation of the cam gear by the drive means will cause the drive pin to slide in the slots of both of the cam follower pieces, simultaneously reciprocating the outer end portions thereof between raised and lowered positions, to simulate flapping of wing members supported thereon.

In the preferred embodiments, the inner and outer end portions of each of the follower pieces will be elongated, and disposed in a substantially obtuse-angular relationship to one another. The slot of the inner end portion of each of the follower pieces will usually be substantially rectilinear, and the drive means will normally be an electric motor. In most instances, the assembly will additionally include a coupling member mounted upon the outer end portion of each of the follower pieces and adapted to provide wing member support, and preferably the coupling members will be disengageably mounted upon the follower pieces. They will advantageously be fabricated from a resiliently deflectable material, and configured to permit relative deflection of inner and outer parts thereof, the inner parts being mounted upon the follower pieces and the outer parts being adapted for wing member support.

Other objects of the invention are attained by the provision of an artificial wing assembly for a winged creature toy, comprising a wing member, a supporting piece, and a coupling member. The wing member has an outer portion and an inner connecting portion, with at least the outer portion being constructed to simulate the wing of a creature. The supporting piece has inner and outer end portions, and the coupling member has an inner part defining a first socket portion, into which the outer end portion of the supporting piece is inserted to mount the coupling member thereon. An outer part of the coupling member defines a second socket portion, into which the inner connecting portion of the wing member is inserted to mount it thereupon. The coupling member is fabricated from a resiliently deflectable material, and is configured to permit relative deflection of the parts thereof to permit movement of the wing member relative to the supporting piece.

In the preferred embodiments of the wing assembly, the outer end portion of the supporting piece will have an enlarged tip element thereon, and the first socket portion will define a recess that extends inwardly from one end of the coupling member. An enlarged section at the innermost end of the recess will be configured to effect mechanical interengagement of the tip element, thereby cooperatively establishing a secure temporary interconnection therebetween.

Additional objects of the invention are attained by the provision of a toy creature with movable wings capable of simulating a flapping action and of producing audible sound thereby. It comprises a creature body, a pair of first wing members, means for movably mounting the first wing members on the body to extend outwardly thereof in generally opposite directions, and means for mounting the second wing members on the body. Each of the second wing members extends outwardly from the body, and in general alignment with one of the first wing members for contact thereby, and means is provided for reciprocating the first wing members thereabout in simulated flapping action. Such movement will effect substantial contact with the aligned second wing members, so as to thereby produce audible sound.

Generally, in such a toy creature at least the major part of each of the wing members will be of generally planar configuration, and the mutually aligned wing members will be disposed in generally parallel planes. The means for mounting the second wing members will usually be substantially fixed on the body, and the reciprocating means will comprise drive means operatively connected to the mounting means for the first wing members. In those instances in which the body is elongated, the wing members will normally be oriented by the mounting means with the planes thereof generally parallel to the longitudinal axis of the body; the pairs of wing members will desirably be spaced from one another substantially on an anterior-posterior axis of the body, with one of the pairs disposed somewhat forwardly of the other. The wing members will generally be fabricated from a sheet of a synthetic resinous material, and a laminate having a component that provides iridescence to the wing members will often be especially desirable.

Still other objects are attained by the provision of a puppet figure comprised of a relatively rigid body, and a sleeve member providing a bulky material partially covering it. The body is comprised of two interengaged sections, an exterior surface portion of one of which is substantially covered by the bulky material, and a corresponding exterior surface portion of the other section being substantially uncovered. The sleeve member will have a first area on which the bulky material is present, and a second area of relatively low bulk and free thereof; it is mounted upon the "one" body section with the first area covering the exterior surface portion, and with the second area disposed between the body sections and clamped in place thereby.

In the preferred embodiments, the "second" area of the sleeve member will be is made of a relative lightweight fabric having elastic properties, to enhance the tightness of the fit of the sleeve member upon the one body section. When the body is elongated, the sleeve member will conveniently be of pocket-like construction, and positioned with the edge defining the opening thereinto disposed at an intermediate point along the length of the one body section. A second, uncovered exterior surface portion may be present on the body section adjacent the first-mentioned portion, with a shallow groove extending therebetween, extension of the edge of the sleeve member into the groove serving to enhance the level of interengagement with the body section.

In more specific embodiments, the figure may be a glove puppet assembly additionally including a movable head component and a glove member adapted to receive the hand of an operator. The glove member will have a portion attached to the body, and at least one independently movable finger portion defined therein and attached to the head component. The assembly will also include holding means on the body, so that the head component can be articulated, by finger-actuated movement of the finger portion of the glove member, while the body is maintained substantially stationary on the operator's hand.

The holding means used will desirably comprise a rigid piece extending from the body and adapted to be gripped by the hand of the operator when inserted into the glove member. The gripping piece will have a central ring element, and flange elements extending outwardly from opposite sides thereof and spaced from the body. The finger portion of the glove member extends through the ring element, and the flange elements are disposed on its opposite sides for gripping by the operator's fingers.

Generally, the glove member will have four additional, independently movable finger portions, each constructed to resemble a leg on the body of the puppet. The operator can use them to simulate walking or crawling of the figure by movement of his fingers, while simultaneously articulating the head. At least the upper surfaces of the finger portions may have a bulky material covering them, to correspond in appearance to a plush-covered section of the body, and the figure may additionally include a collar of plush material disposed substantially at the joint between its head and body portions.

BRIEF DESCRIPTION OF THE DRAWINGS

FIG. 5 is a perspective view of the gripping ring holder used for hand support of the puppet figure, also showing a small section of the body to which the holder is attached;

FIG. 6 is a fragmentary plan view depicting the driving mechanism for the movable wings of the puppet figure, also showing the section of the body in which it is supported;

FIG. 7 is a front elevational view of the mechanism of FIG. 6, with the power transmitting components thereof shown in their lowered wing position;

FIG. 8 is a view similar to FIG. 7 showing the transmission components in their elevated wing position;

FIG. 9 is a perspective view of the coupling member utilized to connect the wing members to the supporting pieces provided on the body of the puppet figure; and FIG. 10 is a plan view of the coupling member of FIG. 9, with the wing member in place and mounted upon the end portion of the supporting piece, showing normal and deflected positions in full and phantom line respectively.

DETAILED DESCRIPTION OF THE ILLUSTRATED EMBODIMENTS

Figure 1:
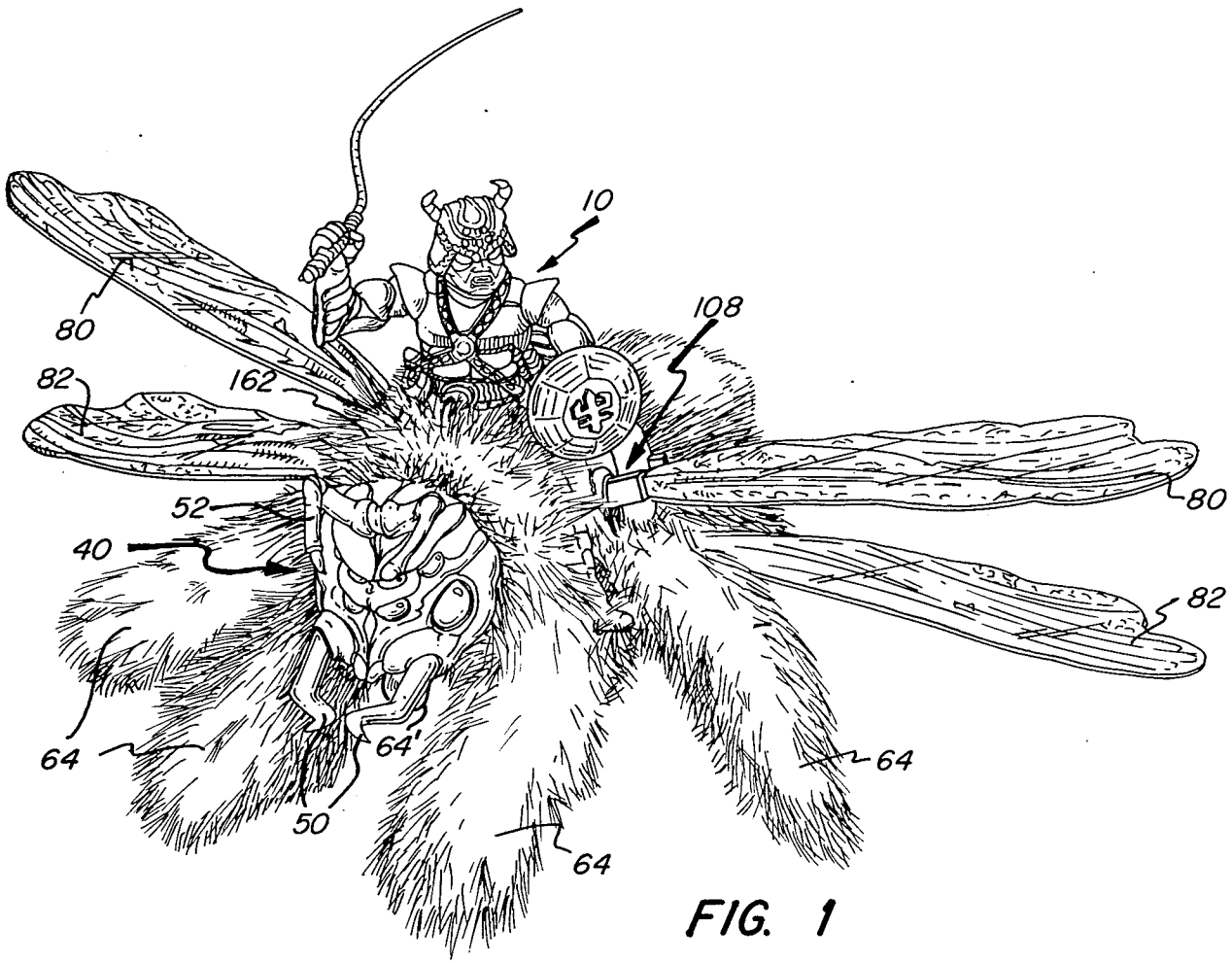
FIG. 1 is a perspective view of a glove puppet figure embodying the present invention, having a humanoid figure seated thereupon.

Although the puppet figure of the invention may take diverse forms, a science-fiction motif is currently regarded to be among the most desirable. Accordingly, FIG. 1 depicts the puppet figure as a winged creature, in combination with a humanoid figure, generally designated by the numeral 10; the humanoid figure is included only for the purpose of better illustrating the thematic concept, and itself constitutes no part of the present invention.

Details of construction of the puppet figure are shown in FIGS. 2–5, from which it can be seen to have a body consisting of an upper section, generally designated by the numeral 12, and a lower section, generally designated by the numeral 14. At the forward end of the body are provided a pivot mount, generally designated by the numeral 16 and interposed between the two sections 12, 14, upstanding cooperating saddle pieces 18, 20, and an underlying gripping ring member, generally designated by the numeral 22. The saddle pieces 18, 20 have depending post portions 24 thereon, which pass through the apertures 28 in the forward part 30 of the upper body section 12, and thereafter through the passages 26 in the pivot mount 16, into the recesses of the upstanding cylindrical bushing elements 34 formed on the base portion 38 of the gripping ring member 22. The elements 34 project through the openings 28 in the forward part 32 of the lower body section 14, and the entire assembly is secured by screws 36, which are inserted through the base portion 38 and are engaged in the ends of the post portions 24. Additional screws (for example, 81 in FIG. 4) are employed at appropriate locations to hold the more rearward parts of the body sections together.

A head of the figure, generally designated by the numeral 40, is pivotably attached to the forward end 19 of the pivot mount 16, which is formed with a laterally extending axle element 42 for that purpose. A pair of laterally spaced, upstanding rib elements 44 are formed along the rear of the skull (only one of which is visible), the lower ends of which are provided with upwardly extending notches 46, to seat the ends of the axle 42 and thereby permit articulation of the head thereabout. As will be appreciated, and as is shown by the full and phantom line representations of FIG. 2, the head 40 is freely pivotable, causing it to assume a lowered position under the force of gravity. For appearance purposes, mouth parts 50 and an antenna-like piece 53 are affixed to the head at suitable locations.

Figure 3:
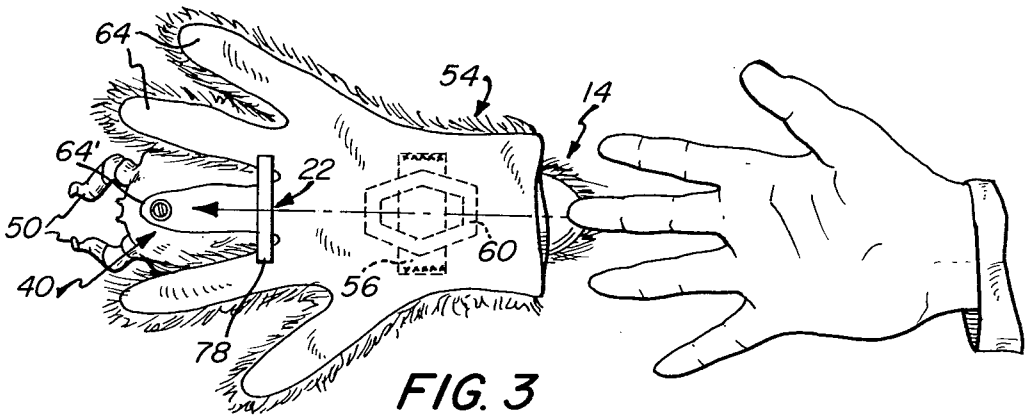
FIG. 3 is a bottom view of the puppet figure of FIG. 1, drawn to a reduced scale and showing the hand of an operator positioned for insertion into the glove member thereof.

Turning now in greater detail to FIG. 3, a glove member, generally designated by the numeral 54, is secured to the lower body section 14 of the puppet figure. It has a band or loop 56 affixed on its back panel 58, which is clamped in place by a substantially hexagonal retainer 60 seated within the correspondingly shaped recess 61 formed in the underside of the lower section 14, and affixed by screws 62 thereto. The glove member has five finger portions 64, the tip of the middle one 64' being attached to the underside of the head 40 by a small plate 66, which is received within a corresponding recess 68 and held in place by a screw 70. In this manner, the finger of the operator can be used to pivot the head upwardly and downwardly about the axle element 42.

The gripping ring member 22 is constructed both to accommodate the middle finger 64' of the glove member 54, and also to enable the operator hold the body of the puppet figure substantially immobile. As best seen in FIG. 5, the gripping member 22 has a ring portion 74, with an opening 76 through which the finger portion 64' is inserted, at the bottom of which are formed laterally extending ears or flange elements 78. As a result, with his hand inserted into the glove member 54 and his middle finger extended through the ring portion 74, the operator's adjacent fingers can be positioned along the outside of the ring portion 74 and curled over the flange elements 78, thereby enabling him to securely grasp the gripping member.

All of the fingers 64 of the glove member 54 are constructed to give the appearance of insect-like legs, the back panel 58 being made of a plush or fur-like material for that purpose. As is suggested in FIG. 1, the fingers of the operator can be moved to "walk" the puppet across a surface, or simply to simulate lifelike activity. Because of the unique design of the gripping ring, movement of the legs (as well as of the head) can be achieved while the body of the creature is held in a stable position relative to the hand.

Figure 4:
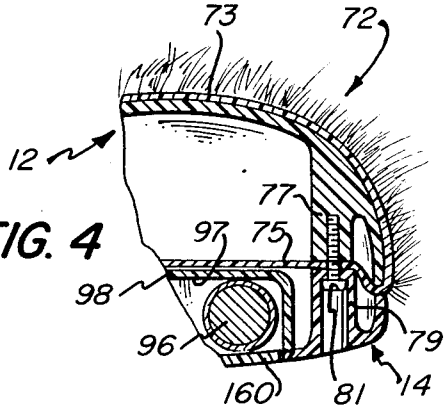
FIG. 4 is a fragmentary sectional view of the body of the puppet figure, taken along line 3—3 in FIG. 2.

With additional reference now to FIG. 4, it can be seen that a further appearance feature of the puppet figure is provided by the application of a fabric covering piece, in the form of a close-ended sleeve or pocket, generally designated by the numeral 72. It consists of an outer panel 73, covered with a plush or fur-simulating material like that on glove panel 58, and an inner panel 75 of a relatively lightweight fabric (free of any such bulky material); the inner panel will desirably be made of a fabric having elastic qualities, such as spandex. The two panels will be joined to one another about their peripheries, leaving an open end, defined by the edge 87, for insertion of the rearmost part of the upper body section 12. In assembly, the fur covered panel 73 will be disposed over the exterior surface, and the lightweight panel 75 will wrap around the peripheral edge of the section 12 and extend thereacross.

The two body sections are secured together by screws 81 (only one of which is shown) which are engaged in cooperating post portions 77, 79 on the upper and lower sections, respectively. As a result, the sleeve 72 is clamped between the mating edges of the two sections, holding it firmly in place, with the elasticity of the panel 75 serving to establish an initial close fit about the upper section 12. Furthermore, the edge 87 of the pocket opening may be engaged in the shallow grove 85 adjacent thereto, to provide added security and to contribute to the neat appearance of the assembly.

As is also best seen in FIG. 1, the puppet figure has four wings, two of which are stationary and the other two being capable of simulated flapping movement. The supporting means and mechanism for mounting and operating the wings are most fully illustrated in FIGS. 6–10.

More specifically, the drive mechanism consists of an electric motor 84 and a transmission assembly disposed within a gear cage, generally designated by the numeral 86 and positioner forwardly thereof. The motor 84 is mounted between the plate 88 of a rear housing piece and an end cap 90, the latter being spaced by a pair of post portions 92 integrally formed on the plate 88 and held in place by suitable fasteners 94. Power for the motor is supplied by a pair of standard dry cell batteries 96, which are retained within the compartment 97 of a battery box structure 98, formed into the lower body section 14 and closed by the hinged door 160, the latter having small lugs (not seen) to lock it in place over the compartment. The batteries 96 are electrically connected to a contact plate 102 by the coil springs 100, in conventional fashion, and suitable leads 104 connect the contact plate to the motor coil through a slide switch 106.

The wings 80 are supported by socket-like coupling pieces, generally designated by the numeral 108 (to be more fully described hereinbelow), which are in turn mounted upon mirror image cam follower pieces, generally designated by the numeral 110. As best seen in FIGS. 7 and 8, each of the cam follower pieces 110 consists of an outer end portion 112 having an enlarged tip 114 thereon, and an angularly offset inner end portion 116, the latter having an elongated, rectilinear slot 118 formed through it and extending at a relatively large obtuse (typically 160°) included angle to the primary axis of the part. Each of the follower pieces 110 has a transverse bore 119 intermediate its outer and inner end portions 112, 116, by which it is pivotably mounted upon a shaft element 120, integrally formed on and projecting forwardly from the plate 88 of the rearward housing piece.

Also assembled within the gear cage 86 is a compound gear consisting of a relatively large element 122 and a relatively small element 124, mounted on a centrally disposed shaft 126. The shaft is journaled between bosses 128, 130, which project from the rearward and forward plates 88, 132, respectively, the plates in turn being spaced from one another by post portions 136 projecting from the plate 88, and secured by fasteners 134. The large component 122 of the compound gear is in meshing engagement with the pinion 138 on the motor shaft 140, and the smaller component 124 is in meshing engagement with a cam gear 142. The latter has a short eccentric drive pin 144 projecting forwardly from one of its faces, which is received in both of the slots 118 of the overlapping inner end portions 116 of the cam follower pieces 110.

Energization of the motor 84 by proper positioning of the switch 106 will effect rotation of the cam gear 142 through the pinion 138 and the compound gear (122/124), causing the eccentric pin 144 to slide within the slots 118, in turn pivoting the follower pieces 110 simultaneously about the shaft elements 120. With the cam gear and follower pieces in the relationship shown in FIG. 7, the wings 80 will be in their fully lowered positions; rotating the cam gear 142 through half a cycle, to the position shown in FIG. 8, will pivot the pieces 110 to an upward orientation, thereby elevating the attached wings. As will be appreciated, continuous rotation of the cam gear 142 will reciprocate the wings 80 between their raised and lowered positions, and will thereby simulate a flapping motion.

Stationary wing members 82 are mounted upon an elongated support piece 150 which extends across the lower section 14 of the body and is fastened thereto by small screws 152. The free ends of the supporting piece are constructed with the same configuration as the outer ends of the follower pieces 110, for insertion into the couplers 108. The outer end portions 112 of both the supporting bracket piece 150 and also of the follower pieces 110 extend, respectively, through openings 154, 156, formed through the upper and lower body sections 12, 14; a small slot 158 is also formed in the upper section 12 to permit access to the slide switch 106.

The couplers 108 for the wing members 80, 82 take the form of rubber sockets having axially aligned recesses 146, 148 extending inwardly from their opposite ends, the couplers being sufficiently flexible to enable resilient deflection of the mounted wing (along the longitudinal axis of the body), as indicated by the phantom line representations of FIG. 10. The recess 146 is dimensioned and configured to receive the outer end portion 112 of either a cam follower piece 110 or the supporting bar 150, as the case may be, and has an enlarged inner portion (unnumbered) dimensioned and configured to engage the tip 114 thereon. This construction enables facile connection and disconnection of the wings, such as for transport and storage.

The oppositely extending recess 148 is dimensioned and configured to receive the inner end portion 81 of a wing member 80, 82, which has a pleated configuration, such as may be produced by laterally compressing the flat wing; this not only facilitates insertion into the recess 148, but also rigidifies the wing member at the point of connection. The cross section of the recess 148 is of course configured to accommodate the end portion 81, and is formed with small, longitudinally extending internal ribs to enhance the level of frictional contact thereupon.

Figure 2:
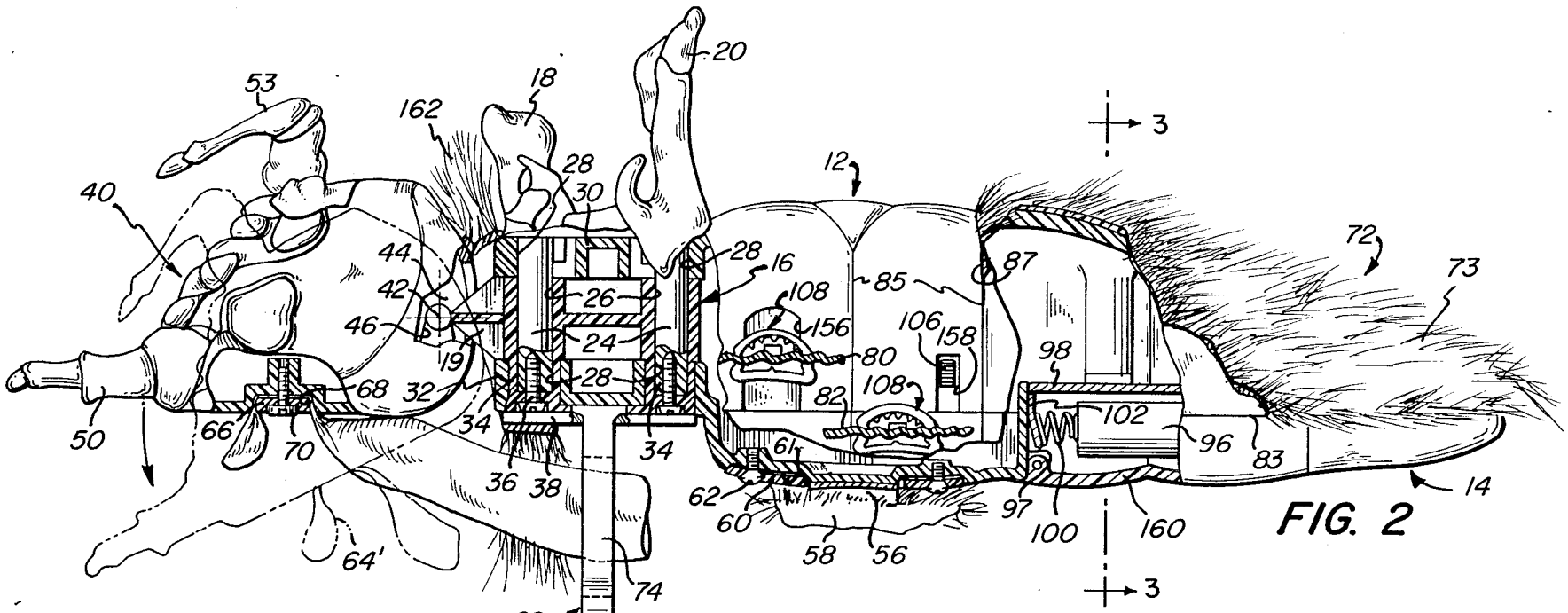
FIG. 2 is a fragmentary elevational view of the puppet figure of FIG. 1, drawn in partial section and to an enlarged scale, and showing in full and phantom line, respectively, the raised and lowered positions of the head.

As can be seen in FIGS. 1, 2, and 6, the movable wings 80 are disposed above (or posteriorly) and slightly forwardly of the stationary wings 82. However, the longitudinal offset and the anterior-posterior (top to bottom) spacing of the pairs of wings on each side of the body are such that they not only overlap, but that they in fact contact one another, over a substantial area, when the upper wings are actuated. Such contact produces an audible sound, similar to a loud flapping noise, the effect of which can be quite pronounced and therefore a source of considerable pleasure for a child playing with the puppet figure.

Finally, a tufted or plush collar 162 is positioned between the head and the body of the puppet figure. Not only does the collar inherently contribute to the aesthetics of the figure, but it also improves its appearance by obscuring an area that looks mechanical, and therefore undesirable in a toy of this nature.

Although various materials of construction can be employed for the several parts of the puppet figure, as will be evident to those skilled in the art, the body and head portions, as well as many parts of the drive mechanism, will desirably be fabricated from suitable plastics. The wings will also normally be made from a synthetic resinous material, which may be in the form of a laminated sheet of acetate or vinyl plastic (typically about ten mils thick), desirably constructed or treated to provide an iridescent or similar optical effect, and patterned with vein-like surface contours. A material particularly preferred for use in fabricating the wing members is the polyvinyl chloride laminate commercially available from the Coburn Corporation, of Lakewood, N.J. under the trade designation DIFRACTO-LIGHT. As indicated above, the drive means for the wing-actuating mechanism may be other than an electric motor; for example, a spring-powered motor may be substituted if so desired.

Thus, it can be seen that the present invention provides a novel glove puppet figure having mechanically driven flappable wings, in which the operating mechanism is of relatively uncomplicated and durable construction. The puppet figure is relatively economical to manufacture, and it may be constructed so that movement of its wings is effective to produce an audible sound. In addition, the glove puppet figure may have an articulated head component attached to a body, which can be moved by finger manipulation while the body is held stationary on the operator's hand. A unique gripping ring holder is employed in the assembly, which not only permits articulation of the head component but also permits movement of the remaining fingers, such as to simulate walking or crawling legs of the puppet figure; the glove member used can serve both aesthetic and also functional purposes.

Having thus described the invention, what is claimed is:

1. In a winged creature toy, a readily removable artificial wing assembly comprising:

a wing member fabricated from a sheet of synthetic resinous material and having an outer portion and an inner connecting portion, said outer portion being constructed to simulate the wing of a creature, and said inner portion tapering therefrom and being longitudinally pleated;

a supporting piece having inner and outer end portions; and a coupling member having an inner part defining a first inwardly extneding socket portion into which said outer end portion of said supporting piece is inserted to disengageably mount said coupling member thereon, and a flared outer part defining a second inwardly extending socket portion into which said inner connecting portion of said wing member is inserted for mounting said wing member on said coupling member, said coupling member being fabricated from a resiliently deflectable material and being configured to permit relative deflection of said parts thereof to permit movement of said wing member relative to said supporting piece.

2. The assembly of claim 1 wherein said outer end portion of said supporting piece has an enlarged tip element thereon, and wherein said first socket portion has a recess with an enlarged section at the innermost end thereof configured to effect mechanical interengagement of said coupling member and said tip element of said supporting piece, thereby cooperatively establishing a secure temporary interconnection therebetween.

3. In a toy creature with movable wings capable of simulating a flapping action and of producing audible sound thereby, the combination comprising:

a creature body;

a pair of first wing members;

a pair of second wing members;

means for movably mounting said first wing members on said body to extend outwardly thereof in generally opposite directions;

means substantially fixed on said body for mounting said second wing members with each of said second wing members extending outwardly from said body and in general alignment with one of said first wing merbers for contact thereby over a substantial area; and means on said body for reciprocating said first wing members thereabout in simulated flapping action and to effect contact with said aligned second wing members, said wing members being so constructed that such contact therebetween will produce audible sound.

4. The combination of claim 3 wherein at least the major part of each of said wing members is of generally planar configuration, and wherein said mutually aligned wing members are disposed in generally parallel planes.

5. The combination of claim 4 wherein said body is elongated, and wherein said wing members are oriented by said mounting means with the planes thereof generally parallel to the longitudinal axis of said body.

6. The combination of claim 3 wherein said reciprocating means comprises drive means operatively connected to said mounting means for said first wing members.

7. The combination of claim 3 wherein said pairs of wing members are spaced from one another substantially on an anterior-posterior axis of said body.

8. The combination of claim 7 wherein said wing members are substantially identical, and wherein one of said pairs is disposed on said body somewhat forwardly of the other of said pairs.

9. The combination of claim 3 wherein said wing members are fabricated from a sheet of a synthetic resinous material.

10. The combination of claim 9 wherein said sheet is a laminate.

11. The combination of claim 10 wherein one of the components of said laminate provides an iridescence to said wing members.

12. The combination of claim 3 wherein said reciprocating means comprises an electric motor having a shaft, and wherein said mounting means for said first wing members is pivotably supported upon said body, said combination additionally including means for operatively connecting said motor to said first wing member mounting means, said connecting means comprising a mechanism for converting rotary movement of said shaft of said motor to reciprocating pivotal movement of said first wing member mounting means, and for transmitting power from said motor thereto.

13. The combination of claim 12 wherein said converting mechanism comprises:

a frame;

a cam gear having a gear portion and a centrally disposed axial shaft portion rotatably mounting said cam gear on said frame, and having a drive pin projecting axially from said gear portion in eccentric relationship to said shaft portion;

a pair of substantially mirror-image cam follower pieces, each having an outer end portion supporting one of said first wing members, and an inner end portion with a slot therein dimensioned to slidingly engage said drive pin, said follower pieces being mounted on said frame, to opposite sides of said cam gear shaft portion, for pivoting about axes parallel thereto and between the inner and outer end portions of said follower pieces, said inner end portions being disposed in overlapped relationship, with said pin slidingly engaged within said slots thereof, said motor being operatively connected to drive said cam gear, whereby rotation of said cam gear by said motor will cause said drive pin to slide in said slots of both of said cam follower pieces, simultaneously reciprocating said outer end portions of said pieces between raised and lowered positions, to simulate flapping of said wing members supported thereon.

14. The assembly of claim 13 wherein said inner and outer end portions of each of said follower pieces are elongated, are directly connected and are disposed in a substantially obtuse-angular relationship to one another.

15. The assembly of claim 14 wherein said slot of said inner end portion of each of said follower pieces is substantially rectilinear.

16. The assembly of claim 13 additionally including a coupling member mounted upon said outer end portion of each of said follower pieces and adapted to provide wing member support.

17. The assembly of claim 6 wherein said coupling members are disengageably mounted upon said follower pieces.

18. The assembly of claim 17 wherein said coupling members are fabricated from a resiliently deflectable material and are configured to permit relative deflection of inner and outer parts thereof, said inner parts being mounted upon said follower pieces and said outer parts supporting said wing members.

19. The combination of claim 3 wherein said means for movably mounting said first wing members comprises a supporting piece and a coupling member joining each of said first wing members thereto, said coupling member being fabricated from a resiliently deflectabel material and being configured to permit relative deflection of parts thereof to permit movement of said wing members relative to said supporting piece.

* * * * *